US011627402B2

(12) United States Patent
Lauridsen et al.

(10) Patent No.: US 11,627,402 B2
(45) Date of Patent: Apr. 11, 2023

(54) HEADPHONE WITH MAGNETIC ATTACHMENT MEANS FOR A CORRESPONDING EAR CUSHION

(71) Applicant: Bang & Olufsen A/S, Struer (DK)

(72) Inventors: Knud-Erik Lauridsen, Herning (DK); Bernardus L Verbraak, Holstebro (DK)

(73) Assignee: Bang & Olufsen A/S, Struer (DK)

( * ) Notice: Subject to any disclaimer, the term of this patent is extended or adjusted under 35 U.S.C. 154(b) by 0 days.

(21) Appl. No.: 17/390,401

(22) Filed: Jul. 30, 2021

(65) Prior Publication Data

US 2022/0038805 A1 Feb. 3, 2022

(51) Int. Cl.
*H04R 25/00* (2006.01)
*H04R 1/10* (2006.01)

(52) U.S. Cl.
CPC ..... *H04R 1/1008* (2013.01); *H04R 1/1058* (2013.01)

(58) Field of Classification Search
CPC .... H04R 1/1008; H04R 1/105; H04R 1/1066; H04R 1/1075; H04R 1/1083; H04R 5/0335
See application file for complete search history.

(56) References Cited

U.S. PATENT DOCUMENTS

2009/0239392 A1 9/2009 Sumitomo et al.
2015/0194764 A1 7/2015 Magana et al.
2018/0220219 A1* 8/2018 Karacal ..... H04R 1/1041
2018/0376232 A1 12/2018 Hardi et al.

OTHER PUBLICATIONS

Extended European Search Report for EP Patent Application No. 21020388.1, dated Dec. 15, 2021, 8 pages.

* cited by examiner

*Primary Examiner* — Amir H Etesam
(74) *Attorney, Agent, or Firm* — Neal, Gerber & Eisenberg LLP; Thomas E. Williams

(57) ABSTRACT

A headphone device comprising a speaker housing and an ear-cushion, the speaker housing comprising a speaker housing side portion and the ear-cushion comprising an ear cushion side portion, where the speaker housing side portion and the ear cushion side portion respectively are configured for releasable connection, wherein said speaker housing side portion comprises a plurality of first permanent magnets provided at respective first locations on or in the speaker housing side portion; said ear cushion side portion comprises a plurality of second permanent magnets provided at respective second locations on or in the ear cushion side portion; where said first locations respectively correspond substantially to one of said second locations; where for each pair of said first and second permanent magnets, the magnetic field of a first permanent magnet, is opposite to the magnetic field of the corresponding second permanent magnet.

10 Claims, 9 Drawing Sheets

HEADPHONE WITH MAGNETIC ATTACHMENT MEANS FOR A CORRESPONDING EAR CUSHION

CROSS REFERENCE TO RELATED APPLICATION

This application claims priority to Danish Application Number PA 2020 00883, filed on Jul. 31, 2020, which is incorporated herein by reference in its entirety.

TECHNICAL FIELD

The present disclosure relates generally to the field of headphones and headphone devices and more specifically to means for ensuring that a correct combination of a headphone speaker housing and an ear cushion is always obtained.

BACKGROUND

In a headphone comprising separate left and right headphone devices (sometimes called "earphones") with corresponding ear cushions, the acoustic characteristics of the respective headphone devices depend both on the characteristics of the components of the headphone speaker housings (for instance on the performance of the electro-acoustic transducer, also called the "speaker"), as well as on possible acoustical and electronic signal processing means such as frequency response equalizers or active noise cancelling means as well as on the acoustic characteristics of the ear cushion, when this is attached to the headphone speaker housing. In high-quality sound reproduction via such headphones it is important that the correct ear cushion and the correct placement of this ear cushion on the corresponding headphone speaker housing is always ensured and that for instance application of a left ear cushion on a right headphone speaker housing and vice versa can be avoided with certainty.

Prior art document U.S. Pat. No. 9,332,337 B2 discloses a headset comprising an earphone and a corresponding ear cushion. In the region of the earphone that faces the ear cushion, the earphone is provided with a number of permanent magnets and in the corresponding side of the ear cushion there is provided a circumferentially extending ring-shaped plate member made of a soft magnetic material, such that the ear cushion can be held attached to the earphone by the magnetic forces acting between the magnets and the ring-shaped member. It is mentioned as an option that the ring-shaped member could also be a permanent magnet. This document does not describe means for ensuring that the angular orientation of the ear cushion is always correct relative to the earphone and as the embodiments shown in this document either used a circular earphone and similar ear cushion or a quadratic earphone and similar ear cushion, the issue of angular orientation of the ear cushion on the earphone is not addressed in the headset described in U.S. Pat. No. 9,332,337 B2. Further, in this document means for preventing the placement of for instance the right ear cushion on the left earphone and vice versa are not disclosed.

SUMMARY

On the above background, it is an object of the invention to provide a headphone with non-interchangeable attachment of left and right ear cushions on the corresponding left and right headphone speaker housings, respectively.

It is a further object of the invention to provide a headphone that ensures that the left (L) and right (R) markings inside the ear cushions (if available) are placed correctly, and thereby ensuring that the user wears the headphones correctly, i.e. that the left headphone speaker housing and corresponding ear cushion is placed on the user's left ear and the right headphone speaker housing and corresponding ear cushion is placed on the user's right ear.

It is a further object of the invention to provide a headphone that ensures that the correct ear cushion always is placed on the correct headphone speaker housing, to maintain the correct electro-acoustical calibration (by tuning the DSP software or otherwise) as originally done in the factory. This is particularly important if the headphones have ANC (Active Noise Cancellation), where the small differences in ear cushions have great influence on the performance of the ANC. But also without ANC, calibration of the headphones to eliminate differences between left and right may be applied, in which case the influence of the ear cushions cannot be neglected and interchanging the left and right ear cushion would render the calibration worthless.

It is a further object of the invention to provide a headphone that ensures that the orientation of both the left and right ear cushions is correct in case of rotation symmetrically shaped ear cushions.

It is a further object of the invention to provide a headphone that insures a correct and precise positioning of the ear cushions on the headphone speaker housings.

The left and right ear cushions according to the invention can be manufactured using injection moulding using one and the same mould and can then be differentiated between left and right merely by the orientation of the magnets to be mounted in the ear cushions. This avoids a need for a mechanical differentiation between the left and right ear cushion which would be needed to avoid interchanging the left and right ear cushion by mistake. This mechanical difference would incur significant additional costs related to a second mould.

In the following, the term "headphone device" is used for the combination of (1) the headphone speaker housing, i.e. the part of the device that contains the electro-acoustic transducer or transducers as well as optional acoustical and electronic signal processing means such as frequency shaping filter means and/or active noise cancelling means and (2) the ear cushion, i.e. the portion of the device that connects the headphone speaker housing with the surface of the user's head. Further, a "headphone" is defined as a device that comprises at least one, but typically two headphone devices, typically a left headphone device and a right headphone device.

The above and further objects and advantages are according to a first aspect of the invention obtained by a headphone device comprising a speaker housing and an ear-cushion, the speaker housing comprising a speaker housing side portion and the ear cushion comprising an ear cushion side portion, where the speaker housing side portion and the ear cushion side portion respectively are configured for releasable connection to each other along an end surface of the ear cushion side portion and a corresponding end surface of the speaker housing side portion, wherein:

the speaker housing side portion comprises a plurality of first permanent magnets provided at respective first locations on or in the speaker housing side portion with each respective magnet generating a magnetic field in a direction substantially perpendicular to the end surface of the speaker housing side portion;

the ear cushion side portion comprises a plurality of second permanent magnets provided at respective second locations on or in the ear cushion side portion with each respective magnet generating a magnetic field in a direction substantially perpendicular to the end surface of the ear cushion side portion;

where each of the first locations respectively corresponds substantially to one of the second locations; and where for each pair of the first and second permanent magnets, the magnetic field of a first permanent magnet provided at one of the first locations is opposite to the polarity of the magnetic field of the corresponding second permanent magnet provided at the corresponding of the second locations, when the end surface of the speaker housing side portion of the speaker housing and the end surface of the ear cushion side portion of the ear cushion are aligned and in contact with each other.

In an embodiment of the first aspect, all magnets in the ear cushion side portion have the same polarity and all magnets in the speaker house side portion have the same polarity opposite to the polarity of the magnets in the ear cushion side portion.

In an embodiment of the first aspect:

the polarity of at least one magnet in the ear cushion side portion is different from the polarity of the remainder of the magnets in the ear cushion side portion, and the polarities of the magnets in the speaker housing side portion are opposite to the polarity of the corresponding magnets in the ear cushion side portion.

In an embodiment of the first aspect:

the polarity of at least one magnet in the speaker housing side portion side is different from the polarity of the remainder of the magnets in the speaker housing side portion, and the polarities of the magnets in the ear cushion side portion are opposite to the polarity of the corresponding magnets in the speaker housing side portion.

In an embodiment of the first aspect the speaker housing side portion comprises four magnets, where the polarities of three of these magnets are the same (N, S) and the polarity of the fourth magnet is opposite (S, N) that of the other three magnets in the speaker housing side portion, and where the ear cushion side portion comprises four magnets located at positions corresponding to the respective magnets of the speaker housing side portion (6), and where the magnets of the ear cushion side portion respectively have the opposite polarity of the respective corresponding magnets in the speaker housing side portion.

In an embodiment of the first aspect the ear cushion side portion is provided with alignment means configured for releasable engagement with corresponding alignment means provided in the speaker housing side portion.

The above and further objects and advantages are according to a second aspect of the invention obtained by a headphone comprising a first and second headphone device (L, R) according to the first aspect and any embodiments hereof, where L and R stands for Left and Right, respectively.

In an embodiment of the second aspect, the polarities of the magnets provided in the first headphone device (L) are opposite the polarities of the respective corresponding magnets provided in the second headphone device (R).

In an embodiment of the second aspect, the polarities of the magnets provided in the plane end surface of the speaker housing of the first headphone device (L) as seen towards the plane end surface of the first headphone device (L) are opposite the polarities of the respective corresponding magnets provided in the plane end surface of the second headphone device (R) as seen towards the plane end surface of the second headphone device (R).

In an embodiment of the second aspect, the first and second headphone devices (L, R) are provided symmetrically about a symmetry axis S of the headphone and the polarities of the magnets in the first (L) headphone device are opposite the polarities of the respective corresponding magnets in the second headphone device (R) that are located at the mirror positions in the second headphone device (R) relative to the symmetry axis S.

In an embodiment of the second aspect, the polarities of the magnets provided in the first headphone device (L) are the same as the polarities of the respective corresponding magnets provided in the second headphone device (R).

In an embodiment of the second aspect, the first and second headphone devices (L, R) are connected to each other by means of a headband or the like such that the first and second headphone devices are provided substantively symmetrically about an axis of symmetry through the headphone.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein FIG. 1(*a*) shows a schematic cross-sectional view of a headphone device according to an embodiment of the invention comprising a headphone speaker housing and an ear cushion.

DETAILED DESCRIPTION

In the following a detailed description of an example embodiment of the invention is given. It is, however understood that the principles of the invention could be embodied in other ways.

Figure 1:
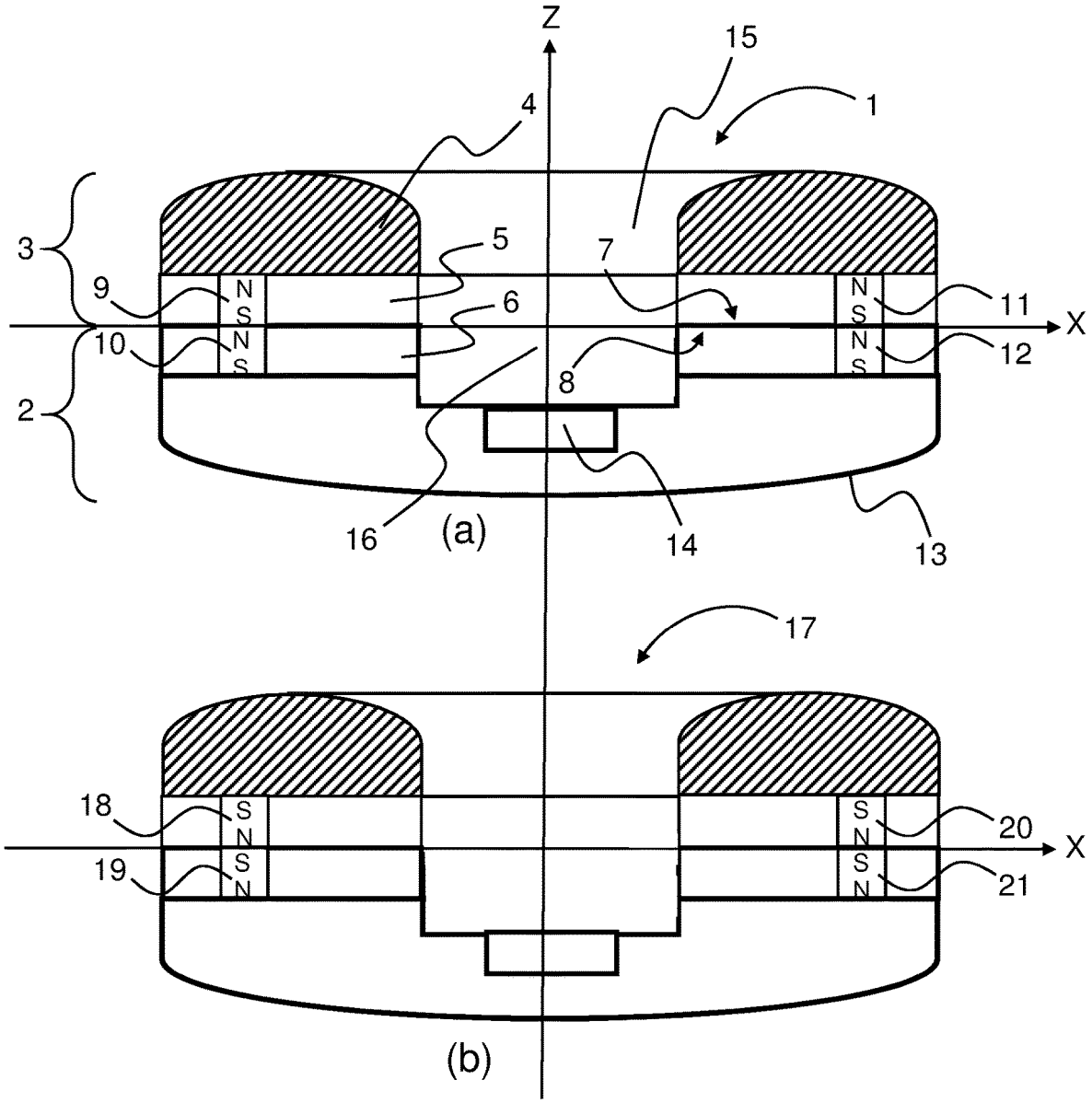
FIG. 1(*b*) shows a schematic cross-sectional view of a second headphone device 17 that may be used in a headphone on the opposite side from the headphone device shown in FIG. 1(*a*) such that for instance the headphone device shown in FIG. 1(*a*) is used as the left headphone device and the headphone device shown in FIG. 1(*b*) is used as the right headphone device of a headphone.

With reference to FIG. 1 there is shown a schematic cross-sectional view of a headphone device according to the invention generally indicated by reference numeral 1 and comprising a speaker housing 2 and ear cushion 3 according to an embodiment of the invention. The ear cushion 3 comprises an ear cushion body 4 attached to an ear cushion side portion 5 in which a plurality of permanent magnets 9, 11 are provided. In the embodiment shown in FIG. 1(*a*), the polarity of the two magnets 9, 11 shown in the figure is as indicated, i.e. with the south pole facing the speaker housing 2. The opposite polarity of the shown magnets could also be used as shown in FIG. 1(*b*) in the magnets 18, 19, 20, 21. The opposing magnets 9, 10 and 11, 12 respectively thus attract each other and the ear cushion 3 is therefore attached releasably to the speaker housing 2. The interface between the ear cushion 3 and the speaker housing 2 is—in the shown embodiment—the plane end surface 7 of the ear cushion 3 and the corresponding plane end surface 8 of the speaker housing 2, but it is understood that other configurations of the interface could also be used. In the speaker housing 2 there is provided an electro-acoustic transducer 14 (a "speaker") that converts an electric audio input signal to an acoustic output signal and thereby generates a sound field in the channel 16 in the speaker housing 2 and the cooperating channel 15 in the ear cushion 3.

The objects of the invention outlined above are according to the invention obtained by specific polarities of the magnets provided in the ear cushion and the speaker housing, respectively. This is illustrated by the non-limiting example shown in FIG. 2, but it is emphasized that other distributions, numbers and specific polarities could also be used and that these would fall within the scope of the invention as defined by the claims.

Figure 2:
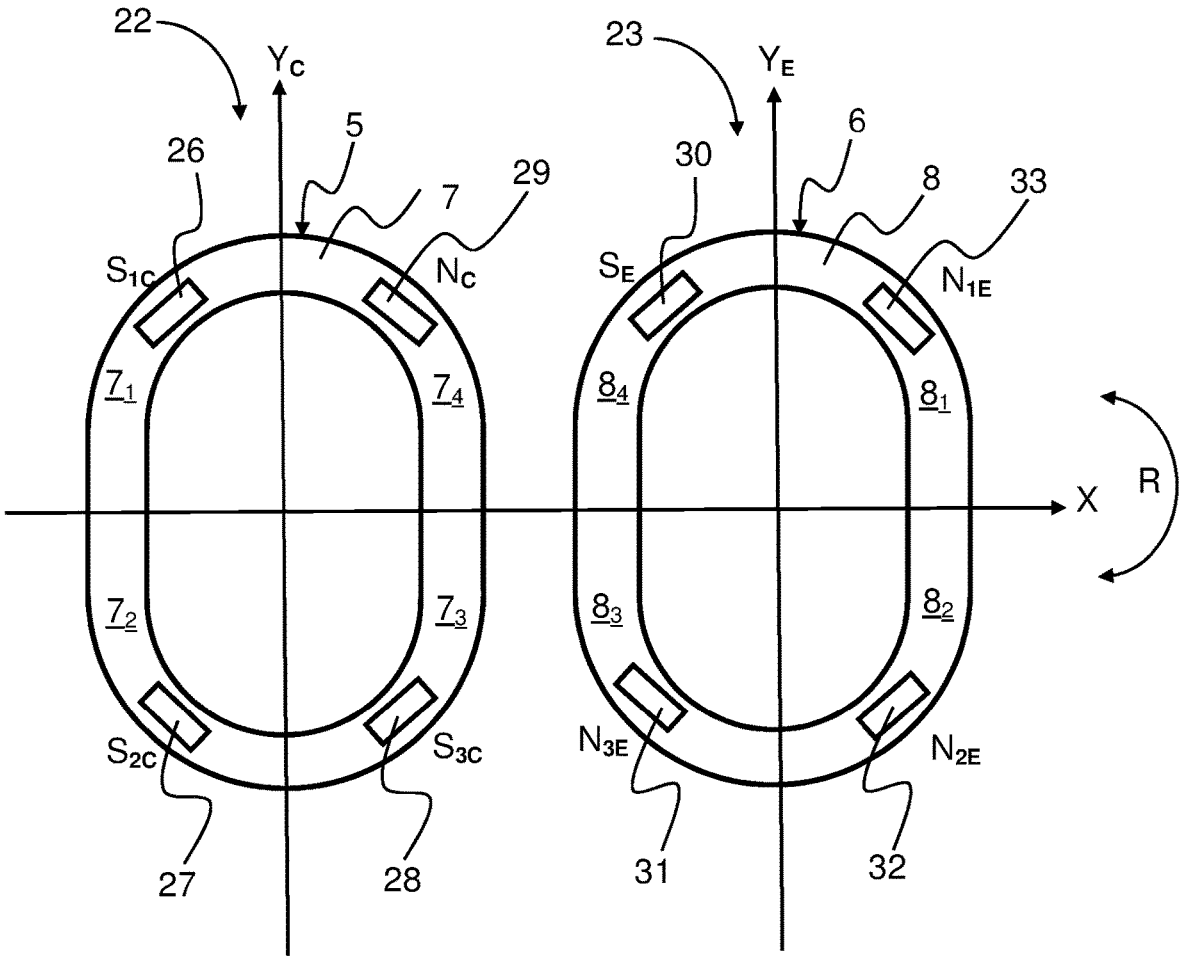
FIG. 2 shows a schematic and simplified representation that illustrates the principle of an embodiment of the present invention.

FIG. 2 shows an ear cushion 22 according to an embodiment of the invention seen from the plane end surface 7 and a speaker housing 23 according to the same embodiment of the invention seen from plane end surface 8. Both the ear cushion 22 and the speaker housing 23 are symmetrical about the perpendicular respective x and y axes ($X$, $Y_C$, $Y_E$) that subdivides the ear cushion 22 and the speaker housing 23 into four portions, each of which comprises one magnet 26, 27, 28, 29 and 30, 31, 32, 33, respectively. In or behind the end surface 7 there are provided four permanent magnets 26, 27, 28, 29. The polarity of the magnets is indicated in the figure. Magnets 26, 27 and 28 have their respective south poles $S_{1c}$, $S_{2c}$ and $S_{3c}$ pointing outwards from the end surface 7, such that they face the end surface 8 of the speaker housing, when the ear cushion and speaker housing are assembled. The fourth magnet 29 has the opposite polarity, i.e. the north pole $N_c$ points outwards from the end surface 7. In or behind the end surface 8 of the speaker housing 23, four magnets 30, 31, 32, 33 are positioned such that they correspond with the magnets 26, 27, 28 and 29 in the ear cushion 22. As it appears from the figure, the polarities for the magnets 30, 31, 32, 33 are opposite to the polarities of the magnets 26, 27, 28, 29, forming attracting magnet pairs 26-33, 27-32, 28-31 and 29-30, and the ear cushion 22 will hence be kept attached to the speaker housing 23 by the magnetic forces of the respective pairs of magnets, when the ear cushion 22 is correctly fitted on the speaker housing 23. If it is attempted to fit the speaker housing 23 to the ear cushion 22 rotated by 180 degrees as indicated by arrow R, different magnets will be opposing each other and the respective polarities of the pairs of magnets 26-31, 27-30, 28-33 and 29-32 will no longer all match (two will match and two will not match) and the respective magnetic forces will repel the ear cushion 22 from its correct position on the speaker housing 23. In this manner it is according to the principles of the invention ensured that the ear cushion 22 is always correctly fitted to the speaker housing 23.

It is emphasized that although the embodiment of the invention shown in FIG. 2 has specifically one magnet located in each of the portions defined by the respective x and y axes, this is not a limitation, and the invention also covers other numbers and/or positions of the magnets 26, 27, 28, 29 and 30, 31, 32, 33 on the respective end surfaces 7 and 8. The basic principle of the invention is that the polarities and positions of the magnets are chosen such that it only allows one correct fitting of the ear cushion 22 on the speaker housing 23. This basic principle of the invention will be reverted to with reference to FIGS. 8, 9 and 10 below.

Figure 3:
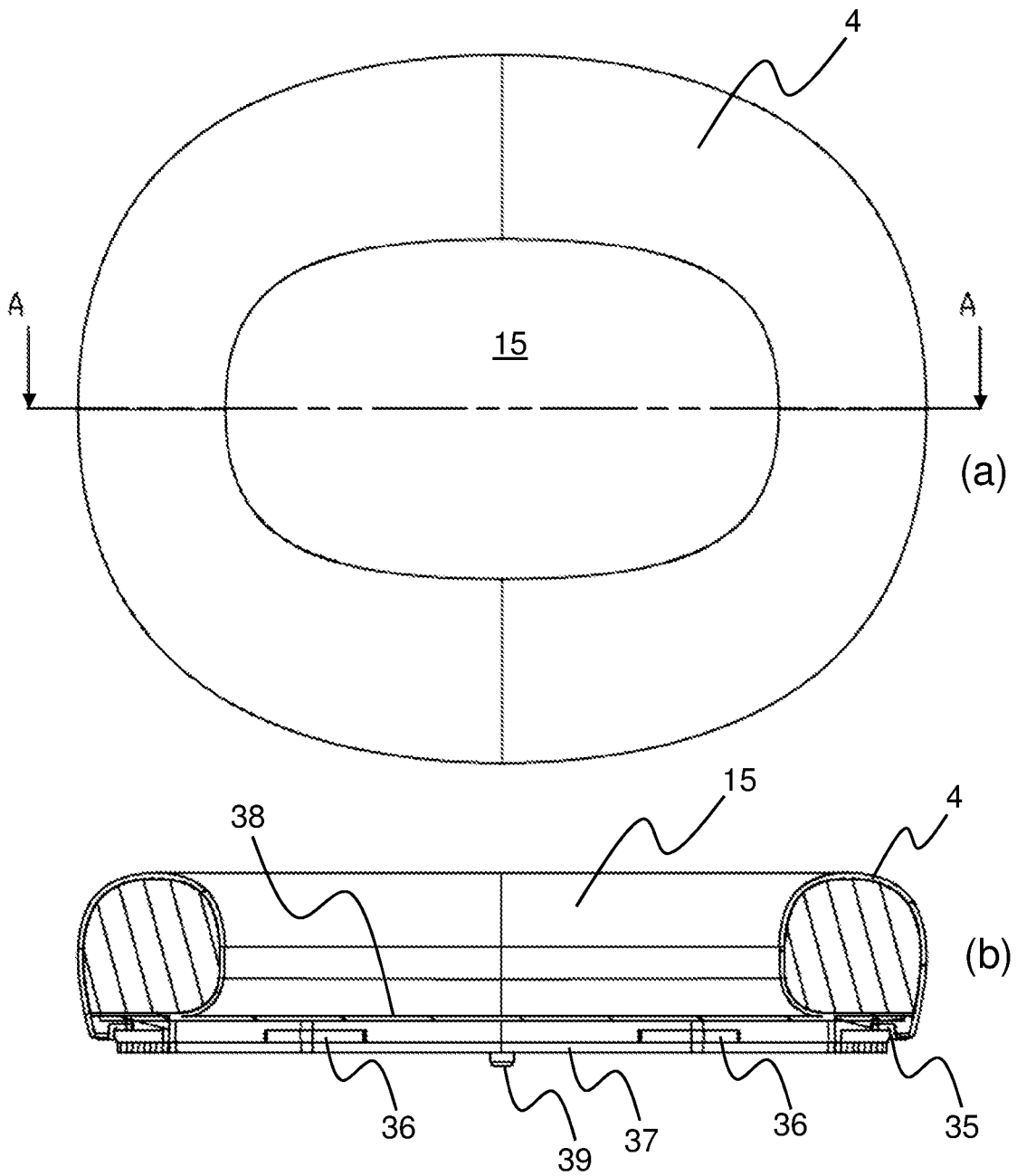
FIG. 3 shows a top view (a) and a schematic partly cross-sectional view (b) of an embodiment of an ear cushion according to the invention.

With reference to FIG. 3 there is shown a schematic partly cross-sectional view of an embodiment of an ear cushion according to the invention. FIG. 3(*a*) shows the ear cushion body 4 surrounding the sound opening 15. FIG. 3(*b*) is a cross sectional view along line A-A in FIG. 3(*a*) in the direction indicated by the arrows A showing the ear cushion body 4 attached by suitable attachment means 35 to a circumferential plate member 37 extending circumferentially all the way round the sound opening 15 and provided with permanent magnets 36. Above the plate member 37 there is provided a protective and sound permeable screen 38. The plate member 37 is further provided with outwardly extending aligning tap members 39.

Figure 4:
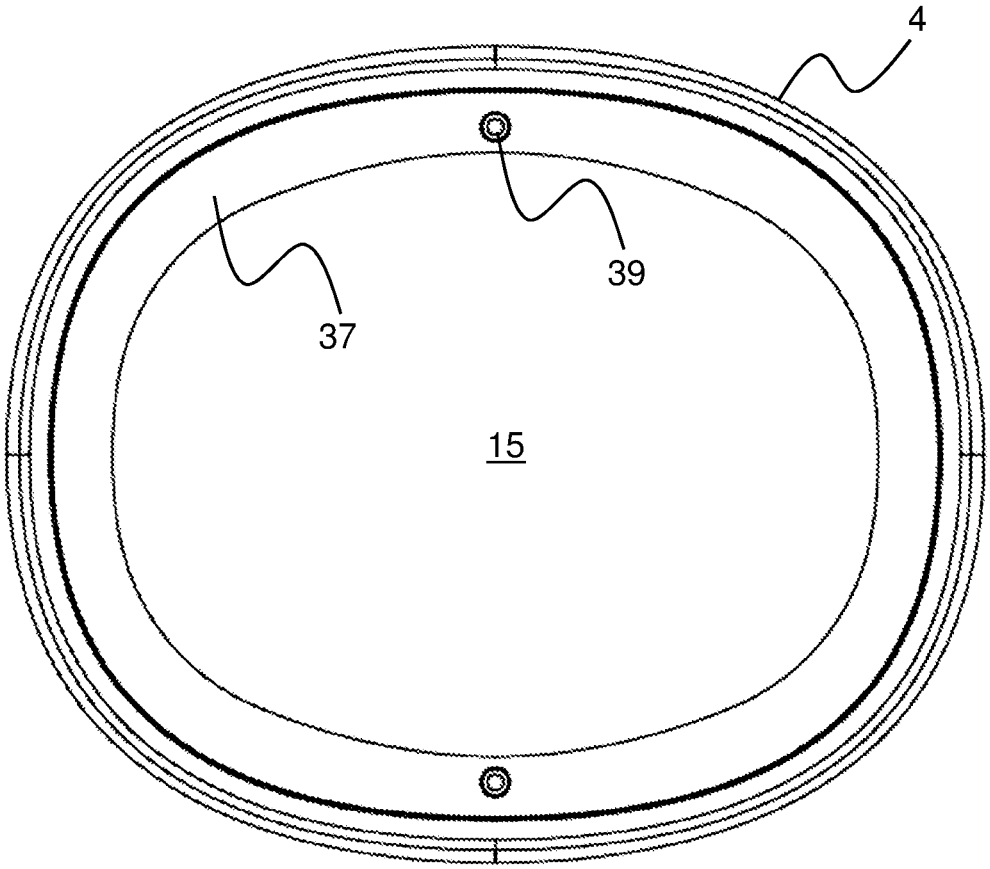
FIG. 4 shows the ear cushion shown in FIG. 3 seen from the side facing the headphone speaker housing.

With reference to FIG. 4 there is shown the ear cushion shown in FIG. 3 seen from the side facing the speaker housing. Two tap members 39 are provided on the circumferentially extending plate member 37 behind which the magnets 36 are provided.

Figure 5:
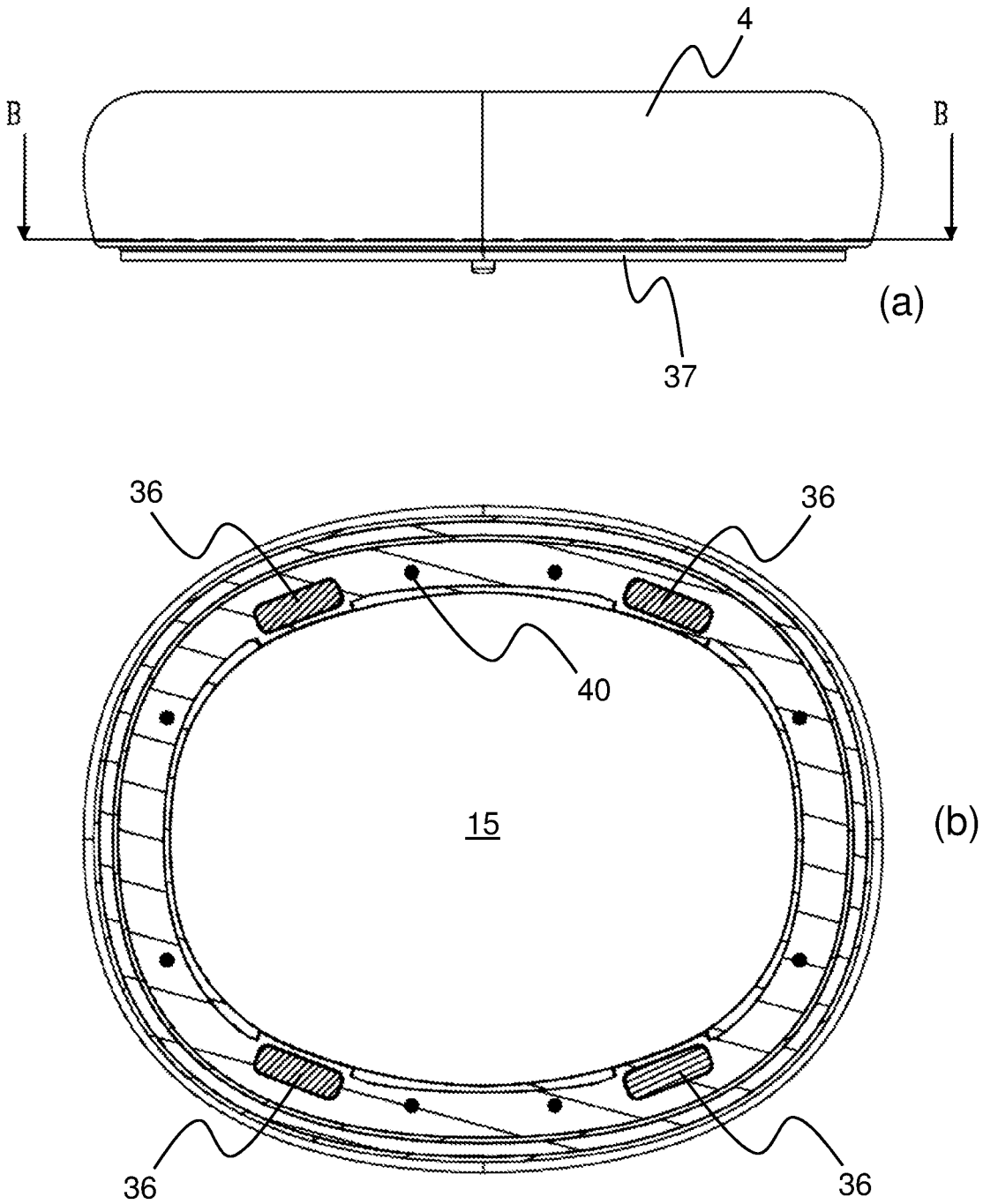
FIG. 5 shows the ear cushion shown in FIG. 3 seen from the side (a) and from the side facing the headphone speaker housing (b) in a cross-sectional view in which the magnets can be seen.

With reference to FIG. 5 there is shown the ear cushion shown in FIG. 3. FIG. 5(*a*) shows a schematic side view of the ear cushion body 4 and the plate member 37 that towards the ear cushion body 4 is provided with the magnets (not shown in FIG. 5(*a*)). FIG. 5(*b*) is a cross-sectional view along line B-B in FIG. 5(*a*) seen from the side facing the speaker housing. The four magnets 36 that are used in this embodiment are shown.

Figure 6:
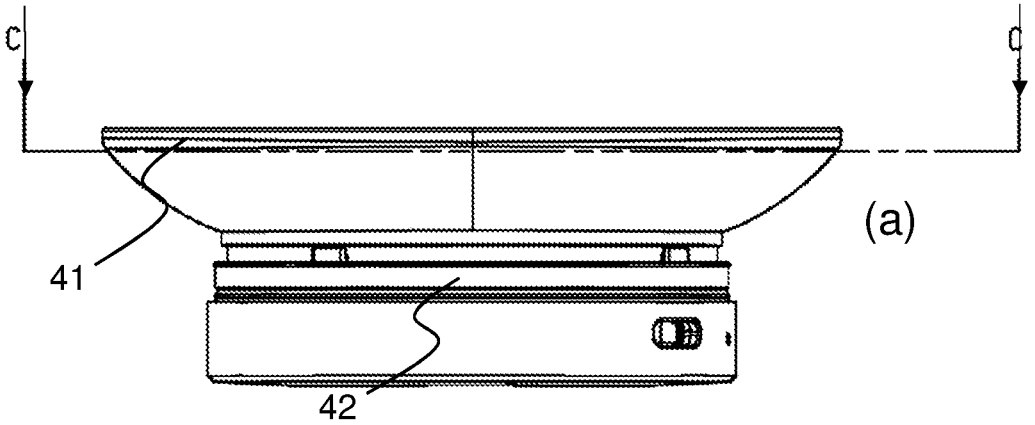
FIG. 6 shows the headphone speaker housing seen from the side (a) and from the side facing the ear cushion (b) in a cross-sectional view in which the magnets can be seen.
Figure 6:
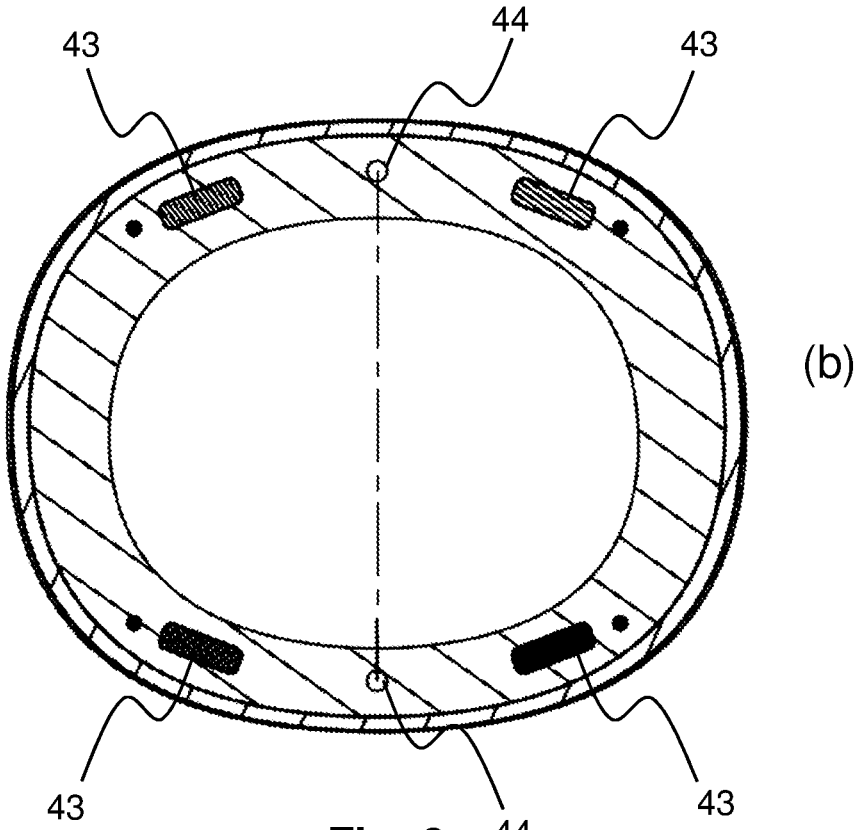

With reference to FIG. 6 there is shown an embodiment of a speaker housing seen from the side (a) and from above (b) in a cross-sectional view along the line C-C in FIG. 6(*a*) seen in the direction indicated by the arrows C (seen from the side facing the ear cushion). The speaker housing comprises an upper section 41 forming a smooth transition to the ear cushion and a portion 42 that among others may comprise the electro-acoustic transducer ("speaker") of the headphone device. In FIG. 6(*b*) the four magnets 43 are shown placed at positions corresponding to the magnets 36 in the ear cushion shown in FIG. 5(*b*). Two housing alignment means (44), for example, without limitation, inwardly extending alignment tap members 44, are also shown, which can engage with corresponding cushion alignment means 39 of the ear cushion, for example, without limitation, a cavity for receiving the housing alignment means (44), as shown in FIG. 4.

Figure 7:
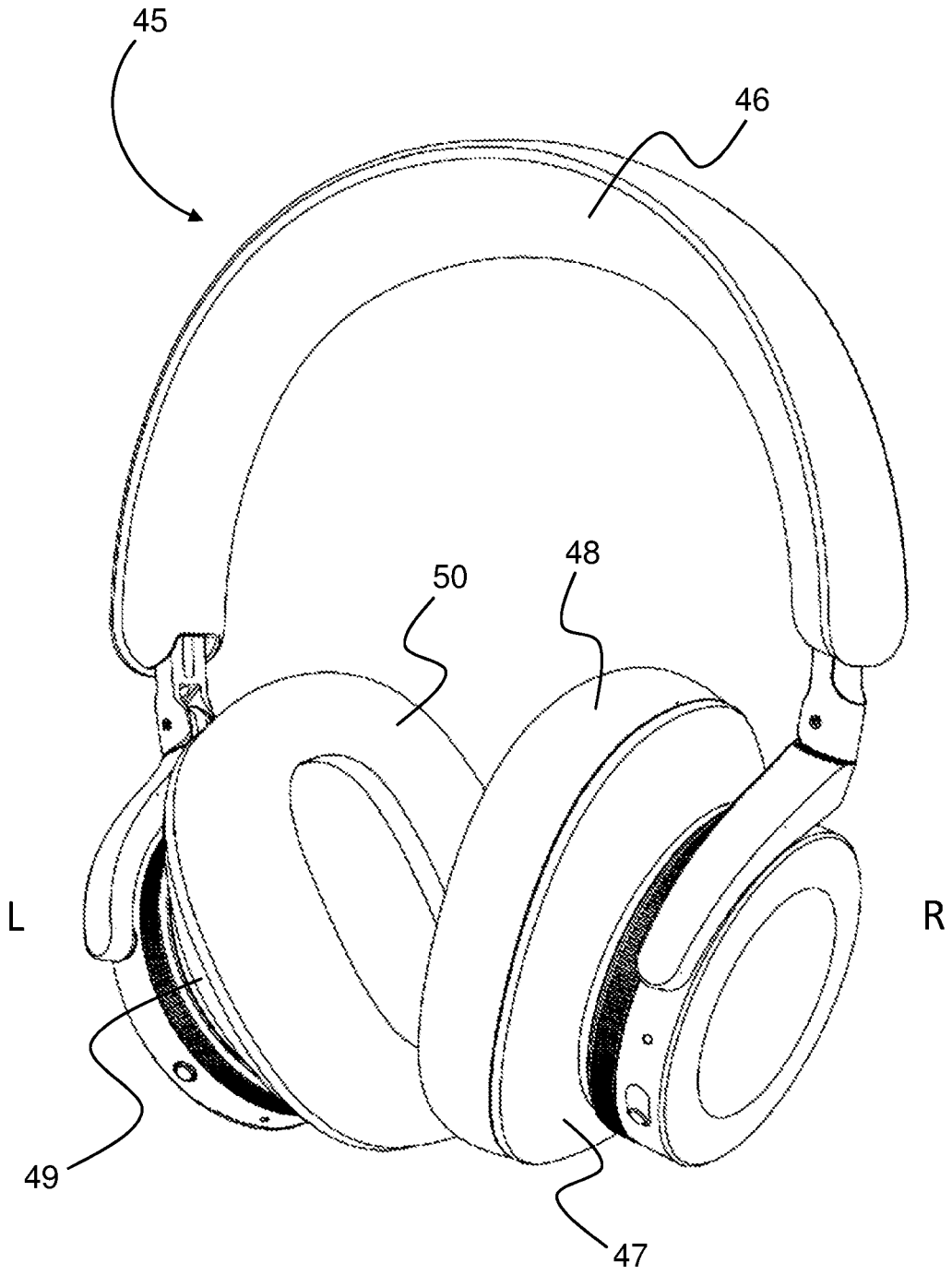
FIG. 7 shows a schematic perspective view of a headphone according to an embodiment of the invention.

With reference to FIG. 7 there is shown a schematic perspective view of a headphone 45 according to an embodiment of the invention comprising a left headphone device L having a left speaker housing 49 and a corresponding left ear cushion 50 and a right headphone device R having a right speaker housing 47 and a right ear cushion 48. The left and right headphone devices L, R are connected by a headband 46.

Figure 8:
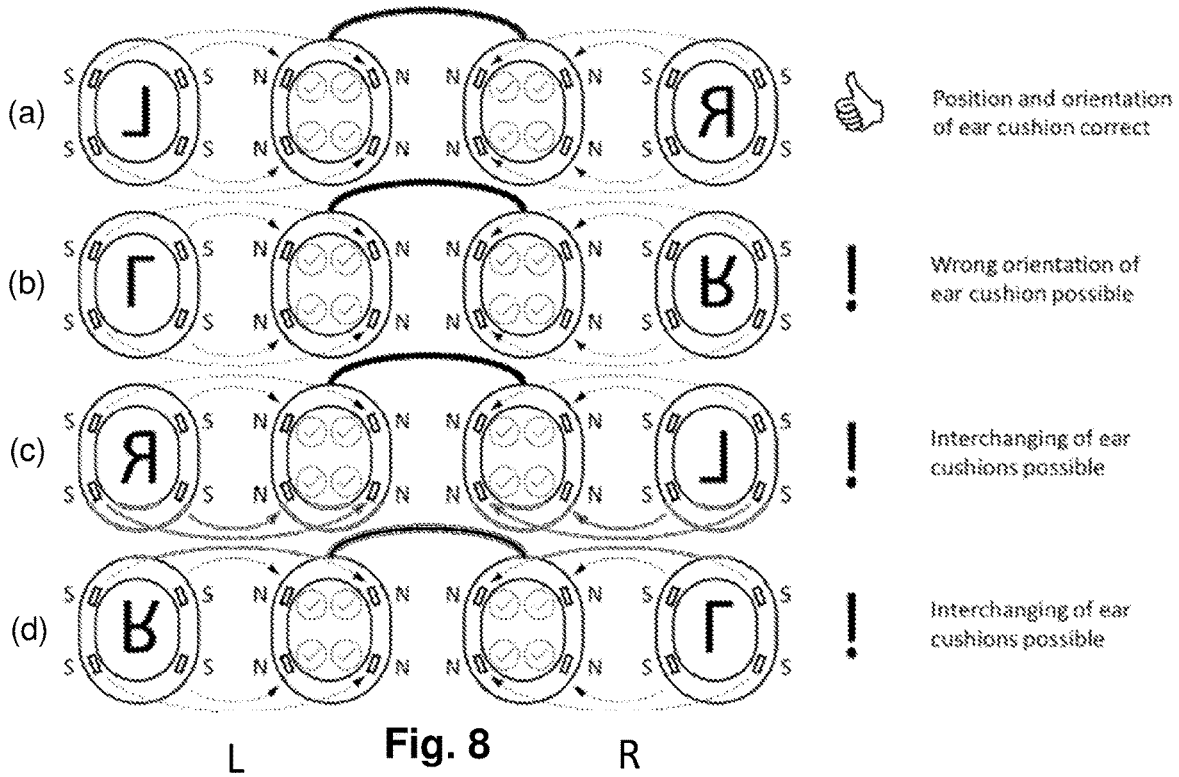
FIGS. 8, 9 and 10 show schematic views of headphones illustrating correct and wrong positioning of the ear cushion on the headphone speaker housing using the principles of different embodiments of the invention.
Figure 9:
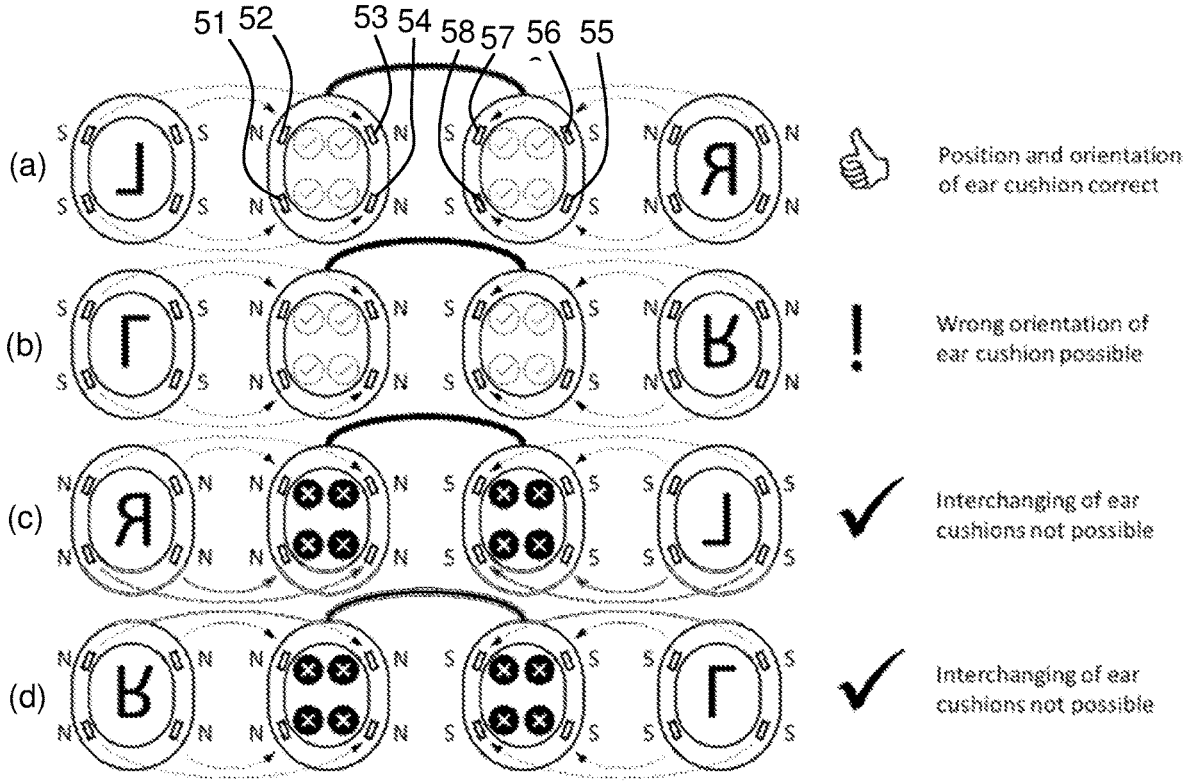
Figure 10:
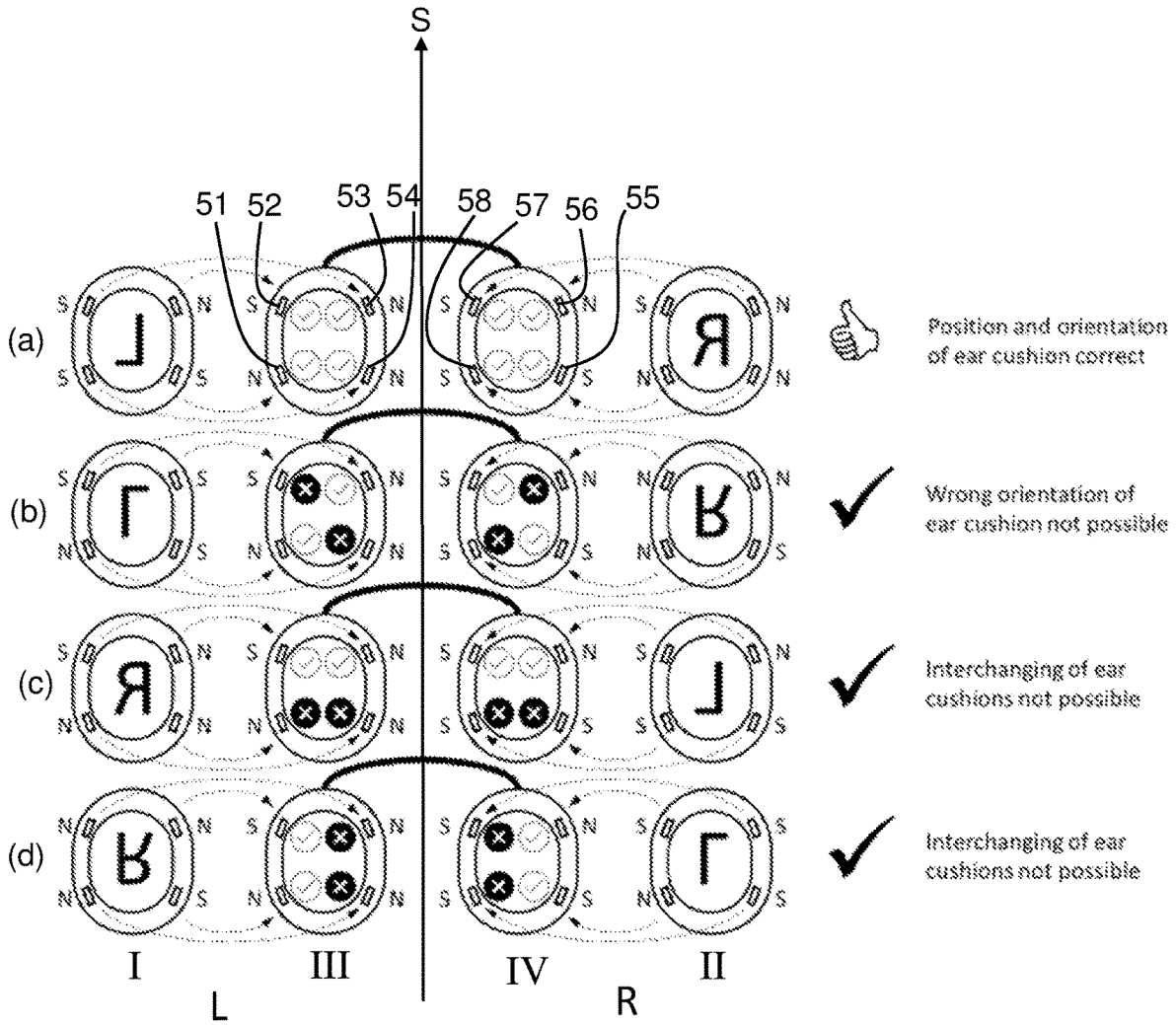

With reference to FIGS. 8, 9 and 10 the advantageous effects of the headphone device and headphone according to the invention is explained. The figures illustrate the effect of different magnet configurations both in the headphone device and in the entire headphone according to the invention.

FIG. 8 shows a magnet configuration that does not prevent a wrong orientation of the respective left and right ear cushion on the corresponding speaker housing and that does also not prevent interchanging of the left and right ear cushions.

FIG. 9 shows a magnet configuration that does prevent interchanging of the left and right ear cushions but does not prevent a wrong orientation of the ear cushions. In FIG. 9, all of the four magnets 51, 52, 53, 54 in the left (L) speaker housing have the same polarity and this polarity is opposite to the polarity of the corresponding magnets 55, 56, 57, 58 in the right (R) speaker housing.

FIG. 10 shows a magnet configuration according to an embodiment of the invention. With reference to (a) of FIG. 10, this configuration ensures that both position and orientation of the ear cushions I and II respectively are correct on the respective two speaker housings III and IV. It is understood that also the opposite polarities of all of the shown magnets shown in FIG. 10 would constitute an embodiment of the invention. In FIG. 10, one (magnet 52) of the four magnets 51, 52, 53, 54 in the left (L) speaker housing has the opposite polarity and this of the other three magnets 52, 53, 54 and the polarity of the magnets 51, 52, 52, 54 respectively is opposite to the polarity of the corresponding magnets 55, 56, 57, 58 in the right (R) speaker housing. In FIG. 10 (and this also applies to FIGS. 8 and 9, although not actually shown in these figures) the headphone is defined by an axis of symmetry S about which the first and second headphone devices (L, R) are located.

Although the invention has been explained in relation to the embodiments described above, it is to be understood that many other possible modifications and variations can be made without departing from the scope of the present invention.

The invention claimed is:

1. A headphone device comprising:

a speaker housing and an ear cushion, the speaker housing comprising a speaker housing side portion and the ear cushion comprising an ear cushion side portion, wherein the speaker housing side portion and the ear cushion side portion respectively are configured for releasable connection to each other along an end surface of the ear cushion side portion and a corresponding end surface of the speaker housing side portion, wherein:

said speaker housing side portion comprises a plurality of first permanent magnets provided at respective first locations on or in the speaker housing side portion with each respective first permanent magnet generating a magnetic field in a direction substantially perpendicular to the end surface of the speaker housing side portion;

said ear cushion side portion comprises a plurality of second permanent magnets provided at respective second locations on or in the ear cushion side portion with each respective second permanent magnet generating a magnetic field in a direction substantially perpendicular to the end surface of the ear cushion side portion;

each of said first locations respectively corresponds substantially to one of said second locations;

for each pair of said first and second permanent magnets, the polarity of the magnetic field of the first permanent magnet, provided at one of said first locations, is opposite to the polarity of the magnetic field of the corresponding second permanent magnet provided at the corresponding of said second locations, when the end surface of the speaker housing side portion of the speaker housing and the end surface of the ear cushion side portion of the ear cushion are aligned and in contact with each other;

the polarity of at least one of the second permanent magnets of the ear cushion side portion is different from the polarity of the remainder of the second permanent magnets of the ear cushion side portion, and the polarities of the first permanent magnets of the speaker housing side portion are opposite to the polarity of the corresponding second permanent magnets of the ear cushion side portion.

2. The headphone device according to claim 1, wherein:

the polarity of at least one of the first permanent magnets of the speaker housing side portion is different from the polarity of the remainder of the first permanent magnets of the speaker housing side portion, and the polarities of the second permanent magnets of the ear cushion side portion are opposite to the polarity of the corresponding first permanent magnets of the speaker housing side portion.

3. The headphone device according to claim 1, wherein the first permanent magnets of the speaker housing side portion comprises four magnets, wherein the polarities of three of the four magnets are the same and the polarity of the other of the four magnets is opposite that of said three magnets, and wherein the second permanent magnets of the ear cushion side portion comprises four magnets located at positions corresponding to the respective four magnets of the speaker housing side portion, and wherein the four magnets of the ear cushion side portion respectively have the opposite polarity of the corresponding four magnets of the speaker housing side portion.

4. The headphone device according to claim 2, wherein the first permanent magnets of the speaker housing side portion comprises four magnets, wherein the polarities of three of the four magnets are the same and the polarity of the other of the four magnets is opposite that of said three magnets, and wherein the second permanent magnets of the ear cushion side portion comprises four magnets located at positions corresponding to the respective four magnets of the speaker housing side portion, and wherein the four magnets of the ear cushion side portion respectively have the opposite polarity of the corresponding four magnets of the speaker housing side portion.

5. The headphone device according to claim 1, wherein the ear cushion side portion comprises a cushion alignment means, wherein the speaker housing side portion comprises a housing alignment means, and wherein the cushion alignment means is configured for releasable engagement with corresponding housing alignment means.

6. A headphone comprising:

a left headphone device and a right headphone device;

a left ear cushion and a right ear cushion; and wherein the left headphone device and the right headphone device are interconnected by a headband;

wherein the left headphone device comprises a left speaker housing that comprises a left speaker housing side portion in which a plurality of left side magnets are provided;

wherein the right headphone device comprises a right speaker housing that comprises a right speaker housing side portion in which a plurality of right side magnets are provided; and wherein the polarities of all of the right side magnets of the right headphone device have the opposite polarity of the respective left side magnets in the left speaker housing side portion of the left headphone device.

7. The headphone according to claim 6, wherein all of the left side magnets provided in the left headphone device have the same polarity.

8. The headphone according to claim 6, wherein at least one of the left side magnets provided in the left headphone device has the opposite polarity of the other of the left side magnets provided in the left headphone device.

9. The headphone according to claim 6, wherein the left ear cushion comprises a left ear cushion side portion provided with left ear cushion magnets at positions corresponding to the left side magnets in the left speaker housing side portion of the left headphone device, where the left ear cushion magnets in the left ear cushion side portion have the opposite polarity to the corresponding left side magnets in the left speaker housing side portion.

10. The headphone according to claim 9, wherein the right ear cushion comprises a right ear cushion side portion provided with right ear cushion magnets at positions corresponding to the right side magnets in the right speaker housing side portion of the right headphone device, where the right ear cushion magnets in the right ear cushion side portion have the opposite polarity to the corresponding right side magnets in the right speaker housing side portion.

* * * * *